United States Patent [19]

Enoki et al.

[11] Patent Number: 4,620,612

[45] Date of Patent: Nov. 4, 1986

[54] EXPANSIBLE CORRIDOR

[75] Inventors: Takahiro Enoki, Hayama; Takashi Hashida, Funabashi, both of Japan

[73] Assignee: Nisso Sangyo Co., Ltd., Japan

[21] Appl. No.: 729,692

[22] Filed: May 2, 1985

[51] Int. Cl.[4] ..... E04G 5/08

[52] U.S. Cl. ..... 182/113; 182/223

[58] Field of Search ..... 182/223, 222, 113, 130

[56] References Cited

U.S. PATENT DOCUMENTS

| | | | |
|---|---|---|---|
| 2,057,092 | 10/1936 | Geib | 182/130 |
| 2,159,902 | 5/1939 | Lewis | 182/113 |
| 2,191;643 | 2/1940 | Deckard | 182/222 |
| 2,415,461 | 2/1947 | Causey | 182/222 |
| 3,282,378 | 11/1966 | Pierce | 182/223 |
| 3,556,254 | 1/1971 | Lambert | 182/223 |
| 3,889,779 | 6/1975 | Kummerlin | 182/223 |

FOREIGN PATENT DOCUMENTS

| | | | |
|---|---|---|---|
| 9147 | of 1911 | United Kingdom | 182/223 |

*Primary Examiner*—Reinaldo P. Machado

*Attorney, Agent, or Firm*—McGlew and Tuttle

[57] ABSTRACT

A corridor spanned or suspended between horizontal support members such as girder members in structures such as those of buildings, ships, etc. so that operators can walk or carry out operations on the corridor.

The corridor comprises a main corridor and a sub-corridor, connected to the main corridor to adjust the length of the corridor.

This corridor can be easily incorporated in and moved from structures to be built, easily transported and housed in narrow spaces and mounted on different length of places by one unit of the corridor.

18 Claims, 16 Drawing Figures

EXPANSIBLE CORRIDOR

BACKGROUND OF THE INVENTION

This invention relates to an expansible corridor and particularly to an expansible corridor spanned or suspended between horizontal support members such as beam members of a structure so that operators can walk and carry out operations on the corridor.

Generally in building structures like buildings, ships, etc., a corridor is spanned or suspended between horizontal support members like beams of buildings or pieces projecting from bottoms of ships to secure so-called scaffoldings and corridors on which operators walk.

This corridor, as shown in FIG. 1 for example, comprises a pair of support girders 1 that are longer than the interval between horizontal support members, a plurality of single pipes 2 spanned between the support girders 1 and spaced properly from each other, a plurality of long scaffolding plates 3 mounted on these single pipes 2, a plurality of struts 4 consisting of pipes or the like secured fixedly to the support girder 1 on the lower end and projecting upward and hand-rail pipes 6 secured fixedly to the struts 4 through clamps 5 and interconnecting the heads of the struts 4. On the other hand, since the distance between the horizontal support materials spanned by this corridor is not constant, but long or short, the length of the support girder 1 or scaffolding plate 3 constituting the corridor must be longer than at least the distance between the horizontal support members, and various lengths of the scaffolding plates 3 or support girder 1 must be prepared for the distance between the horizontal support members. Thus, to provide a desired corridor in a building site, various lengths of the scaffolding plates 3 and girder member 1 together with a plurality of the other pipe members or the like must be prepared while a large storage space is uneconomically needed when they are stored in an idle time. When a desired corridor is assembled by utilizing these members, not only the transfer of long scaffolding plate 3 and girder member 1 is inconvenient, but also great care must be taken in the assembly operation which tends to be carried out in an elevated spot, resulting in very bad operability. Further, it is very difficult in a building spot having a narrow space to transfer the once assembled corridor to another place since a large amount of labor and time is inconveniently needed for the transfer operation.

That is, it is impossible for one operator to carry the scaffolding plate 3, etc. since they are long, and when the corridor is transferred in a narrow place with a plurality of operators and a crane, the long scaffolding plate 3 collides with the other building materials and structures and the direction of transfer is difficult to change so that the transfer operations are remarkably troublesome.

SUMMARY OF THE INVENTION

Accordingly, a principal object of this invention is to provide an expansible corridor which can be freely spanned or suspended corresponding to even different lengths of installation.

Another object of this invention is to provide an expansible corridor which is simply incorporated or removed.

A further object of this invention is to provide an expansible corridor which is easily carried and housed.

A still other object of this invention is to provide an expansible corridor which can be simply transferred from one spot to another even in a building site having a small space.

A still further object of this invention is to provide an expansible corridor which can constitute a continuous path or scaffolding longitudinally and laterally by adding or connecting freely a plurality of corridors.

The expansible corridor according to this invention to achieve these objects is spanned or suspended between a plurality of support members such as girder members of structures to be built so that operators can walk or carry out building operations on the corridor, and characteristically consists of a main corridor and a sub-corridor connected to one end or both ends of said main corridor and capable of adjusting the length.

DESCRIPTION OF THE PREFERRED EMBODIMENT

Figure 1:
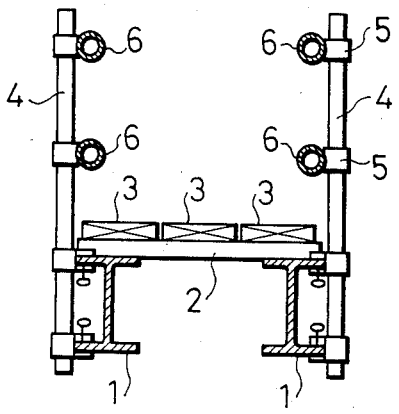
FIG. 1 is a longitudinal sectional view showing a prior temporary corridor.

Hereinafter will be described this invention on the basis of the embodiments shown in the drawings.

Figure 2:
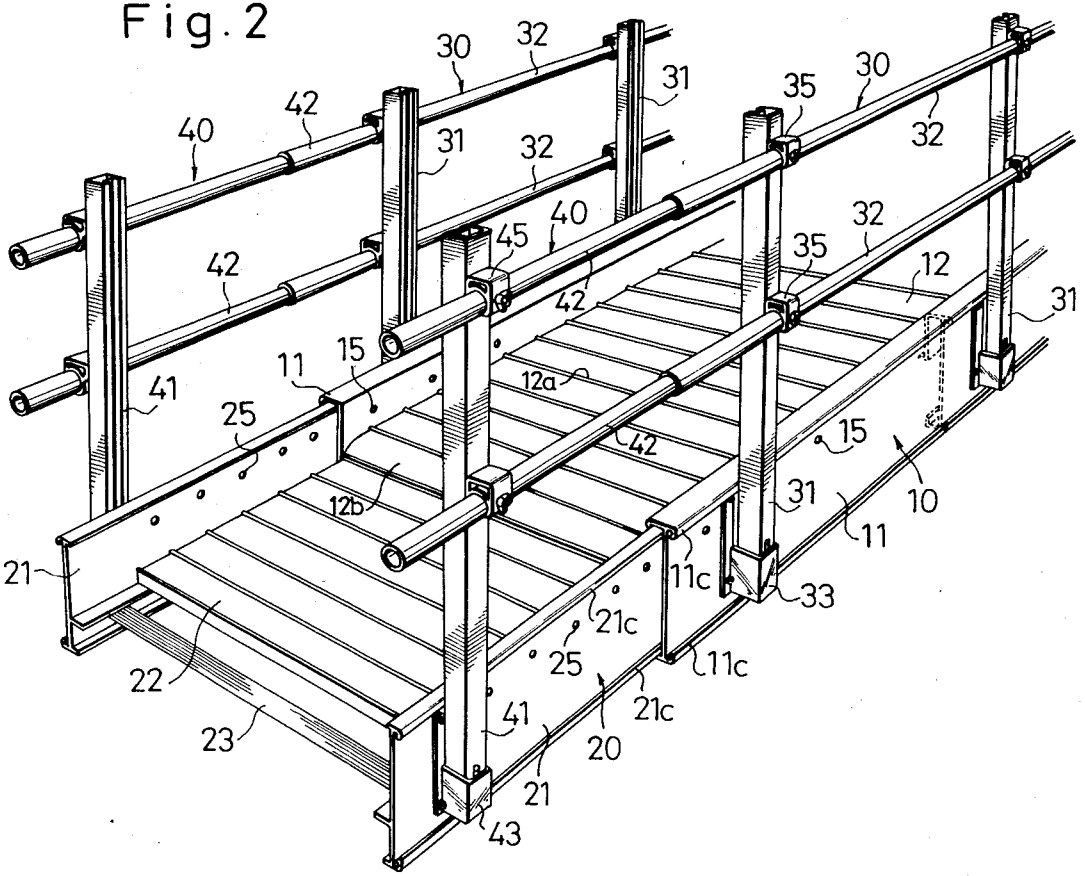
FIG. 2 is a perspective view showing partially an expansible corridor according to this invention.

As shown in FIG. 2, the expansible corridor according to this invention consists of a main corridor 10 and a sub-corridor 20 having respectively hand-rails 30, 40 foldably attached. The sub-corridor 20 is inserted removably in one end or both ends of the main corridor 10 so that the whole length of the corridor can be expanded and contracted at will by exiting and entering of the sub-corridor. Further, even corridors of slide system and slidable insertion system can be used so long as the sub-corridor 20 is incorporated in the main corridor 10 to adjust the length.

Figure 3:
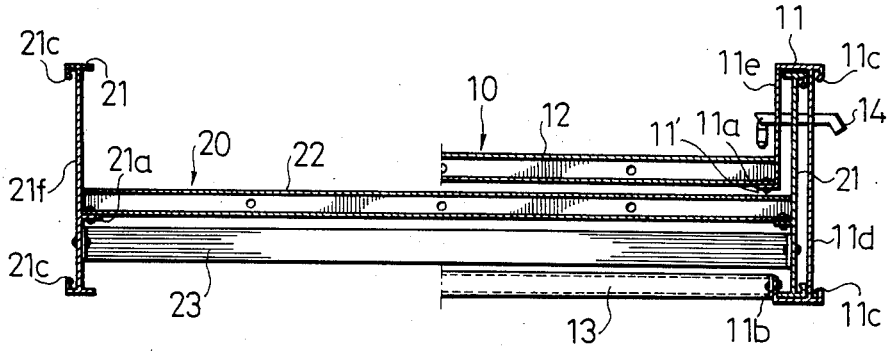
FIG. 3 is a longitudinal sectional view showing a main corridor and a sub-corridor.

The main corridor 10 consists of a pair of girder members 11 of hollow frame bodies and horizontal scaffolding plates 12 successively laid between the insides of the girder members 11, and said hand-rails 30 are attached to these girder members 11. As shown in FIG. 3, the girder member 11 consists of a longitudinally long section having a box-shaped profile into which a girder member 21 of frame body of the sub-corridor 20 can be inserted while the girder member 21 is held not to be withdrawn in the vertical and outside directions. Also, the girder member 11 has a longitudinal opening portion 11' through which a scaffolding plate 22 fixed to the girder member 21 of the subcorridor 20 is inserted horizontally. The opening portion 11' is formed on the upper edge with a horizontal support portion 11*a*, to which is secured fixedly the scaffolding plate 12. And the opening portion 11' of the girder member 11 is formed on the lower edge with a riser portion 11*b* which prevents the lower end of the girder member 21 of the sub-corridor 20 from laterally and vertically dropping out of the interior of the girder member 11 of the main corridor 20. Further, a foot securing member 13 is secured fixedly between the risers 11*b* at both sides to prevent a gap between the lower ends of the girder member 11 from expansion.

Further, while the girder member 11 is formed on the upper and lower outside ends with a reinforcing portions 11*c*, the formation of the reinforcing member 11*c* may be of course omitted when the outside shell portion 11*d* of the girder member 11 is formed to have sufficient self-supporting property. Also, while the support portion 11*a* formed projectingly on the upper end edge of the inside opening portion 11' of the girder member 11 is provided projectingly for reinforcing the inside shell portion 11*e* of the girder member 11, the projecting formation of the support portion 11*a* may be omitted when the inside shell portion 11*e* is formed to have sufficient self-supporting property. In omitting the projecting formation of the support portion 11*a*, the scaffolding plate 12 is connected to the inside of the girder member 11 by utilizing a suitable connector or the like.

While the scaffolding plate 12 may provide on the approximately central portion of the girder member 11 of the main corridor 10 as shown in FIG. 3, it may be provided on the upper or lower portion of the girder member 11.

Figure 9:
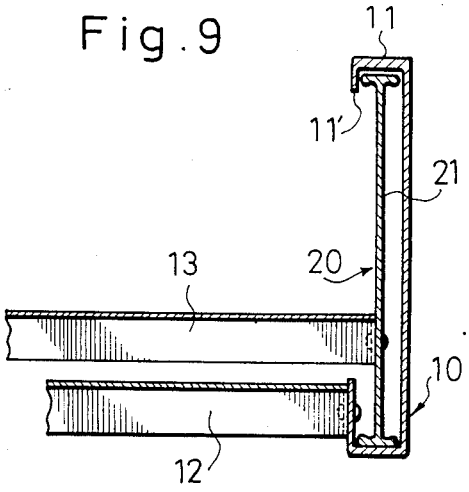
FIG. 9 is a partially cut-away longitudinal sectional view showing the corridor according to another embodiment of this invention.

While the scaffolding plate 22 of the sub-corridor 21 is located below the scaffolding plate 12 of the main corridor, the scaffolding member 12 may be fixedly bolted or welded to the lower inside of the girder member 11 of the main corridor 10 as shown in FIG. 9 and on the other hand the scaffolding plate 13 provided on the girder member 21 of the sub-corridor 20 may be extended horizontally from the opening portion 11' while being located above the scaffolding plate 12 of the main corridor 10.

Figure 4A:
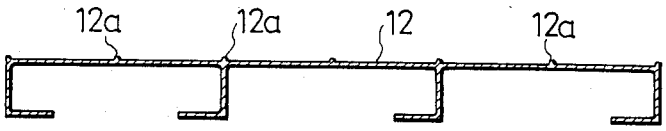
FIG. 4(A) is a longitudinal sectional view showing a scaffolding plate.

As shown in FIG. 4(A), the scaffolding 12 is formed like a panel made of metal plate having proper thickness. The metal plate is formed on the upper surface with antiskid ribs 12*a* formed projectingly at proper intervals. While this scaffolding plate 12 is made of metal panel in this embodiment, it may be replaced by a long one made of playwood. What is essential is that it is constituted to ensure a footpath or the like for operators on the main corridor 10. Thus, the antiskid ribs 12*a* formed on the upper surface of scaffolding plate 12 in this embodiment may be of course replaced by dot-shaped or mesh-like projections. However, when the antiskid ribs are formed like in this embodiment, the upper surface of the scaffolding plate 12 can advantageously improve the durability against bending.

Figure 4B:
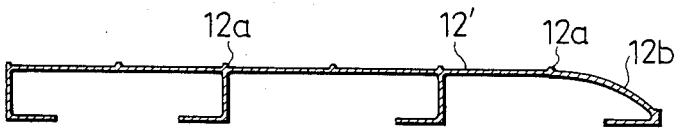
FIG. 4(B) and 4(C) are longitudinal sectional views showing scaffolding plates in the other embodiments.
Figure 4C:
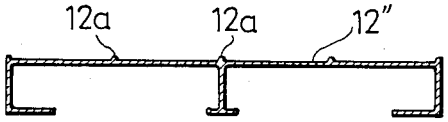

Further, when the scaffolding plate 12 according to this invention is provided in the middle of the main corridor 10, the scaffolding plate shown in FIG. 4(A) is used. However, when it is provided on the end of the main corridor 10, it is formed on the upper surface of one end with a curved surface portion 12*b* as shown in FIG. 4(B), and the scaffolding plate 12 for the end contemplated not to produce a step between itself and the scaffolding plate 22 of the sub-corridor 20 is utilized. Further when the girder members 11 are different from each other in the length, a small width scaffolding plate 12" for adjusting the length as shown in FIG. 4(C) is added if necessary.

The respective scaffolding plates 12 are connected to each other by utilizing rivets or bolts and nuts, and the scaffolding plate 12 is connected to the girder member 11 by utilizing rivets or bolts and nuts.

The sub-corridor 20 is constituted from a pair of left and right girder members 21 of frame body and the scaffolding plates 22 connected between these girder members 21. The girder members 21 slide in the girder member 11 of the main corridor 10 so that the sub-corridor 20 can enter and exit the main corridor 10 while hand rails 40 are attached to the girder member 21. As shown in FIGS. 2 and 3, this girder member 21 is made of an l-shaped section as a whole and has a support portion 21*a* projected to the side surface opposed to the inside surface somewhat below the center of the section, i.e. the side surface opposed to the other girder member 21. To this support portion 21 a is fixedly secured the scaffolding plates 22 by rivets or the like. Also, while the girder member 21 is formed on the upper and lower outside ends with reinforcing portions 21*c* may be omitted when the central portion 21*f* of the girder member 21 is formed to have sufficient self-supporting property. However, this reinforcing member 21*c*, when provided, becomes advantageously a reliable guide for the girder member 21 when the girder member 21 is inserted in the girder member 11 of the main corridor 10.

The scaffolding plate 22 in the sub-corridor 20 is not different from the scaffolding plate 12 in said main corridor 10 in the principal constitution. That is, it is identical with that shown in FIGS. 4(A),(C) in the sectional profile.

Further, a pipe 23 having a wave-shaped section is interposed between ends of the sub-corridor 20, i.e. the girder members 21 to prevent the gap between the girder members 21 from lateral expansion while being utilized for a handle to withdraw the sub-corridor 20 by a desired length from the main corridor 10 (see FIGS. 2 and 3).

Thus, by withdrawing the girder member 21 of the sub-corridor 20 from the girder member 11 of the main corridor 10 is elongated the length of the whole corridor, and, on the contrary, by pushing the girder member 21 of the sub-corridor 20 into the girder member 11 of the main corridor 10 is shortened the length of the whole corridor. In other words, the corridor is rendered expansible.

Figure 5:
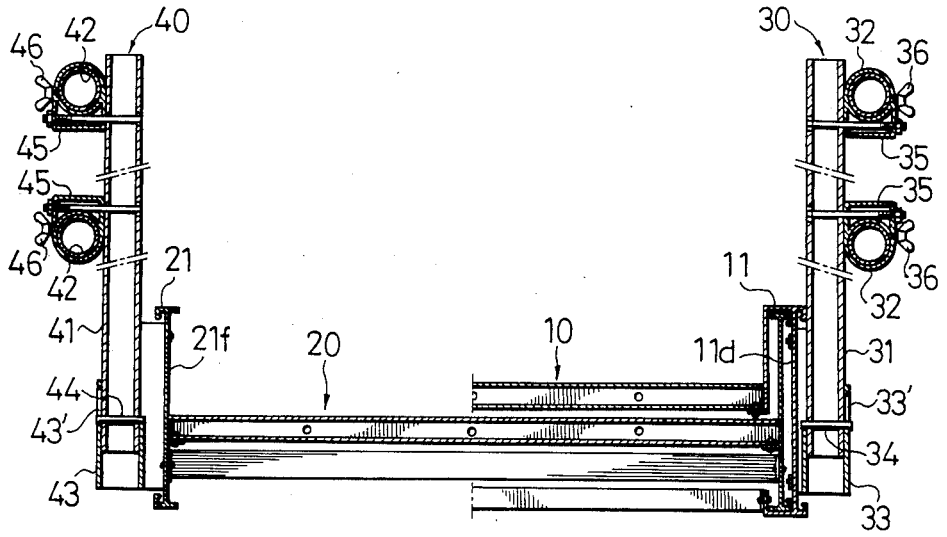
FIG. 5 is a longitudinal sectional view showing hand-rails together with the main corridor and sub-corridor.

As shown in FIG. 2 and on the right hand of FIG. 5, the hand rail 30 attached to the main corridor 10 consists of struts 31 having the lower ends supported foldably by the girder member 11 and a cross bar 32 held connectively by the heads of the struts 31. And the hand rail 40 attached to the sub-corridor 20, as shown in FIG. 2 and on the left hand of FIG. 5, consists of struts 41 having the lower ends foldably supported by the girder member 21 and a cross bar 42 held by the struts 41, the hand rail cross bar 42 having the end connectively entering and exiting the hand rail cross bar 32 of the main corridor 10.

Figure 6:
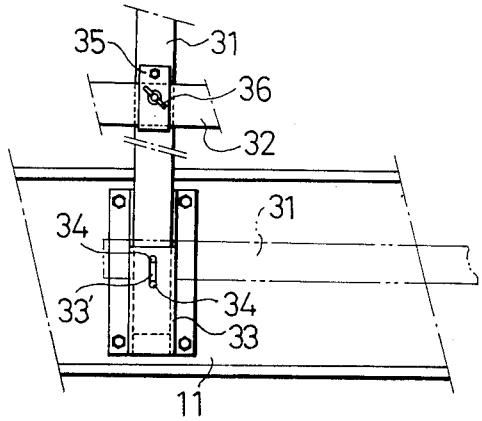
FIG. 6 is a partial side view showing the positions of erected and folded hand-rail.

The struts 31, 41 have the lower ends inserted respectively into sockets 33, 43 secured fixedly to the outside shell 11*d* of the girder member 11 or the central portion 21*f* of the girder member 21, and the respective sockets 33, 43 are provided with slots 33', 43' formed longitudinally. In the respective slots 33', 43' are inserted pins 34, 44 formed on the lower end of the respective struts 31, 41. Thus, when the respective struts 31, 41 are pulled up to lift the pins 34, 44 along the slots 33', 43', the lower ends of the respective struts 31, 41 are disengaged from the sockets 33, 43 so that, as shown by the chain line in FIG. 6, the respective struts 31, 41 are rotated clockwise about the pins 34, 44 to be folded longitudinally of the corridor. The sockets are all laterally open to allow the struts to rotate down after the struts are lifted.

Also, the cross bars 32, 42 made of round pipe are held by clamps 35, 45 connected pivotably to the respective struts 31, 41 on the two upper and lower stages. And the clamps 35, 45 have respectively butterfly bolts 36, 46 which are tightened to secure fixedly the cross bars 32, 42 inserted into the clamps 35, 45. Since the cross bar 42 in the hand rail 40 of the sub-corridor 20 is inserted into the cross bar 32 in the hand rail 30 of the main corridor 10, the grid-like hand rails 30, 40 consisting of the struts 31, 41 and cross bars 32, 42 will be folded longitudinally of the corridor in the form of parallelogram when the struts 31, 41 are rotated clockwise and folded. Also, when the struts 41 in the hand rail 40 of the sub-corridor 20 are folded, the cross bar 42 is withdrawn from the clamp 45, when the cross bar 42 can be pushed and housed in the cross bar 32 in the hand rail 30 of the main corridor 10.

In the corridor of said embodiment, while the one stage sub-corridor 20 enters and exits connectively one or both ends of the main corridor 10, a multiple stage sub-corridor 20 instead may be formed expansibly to enter and exit one or both ends of the main corridor 10.

Figure 7:
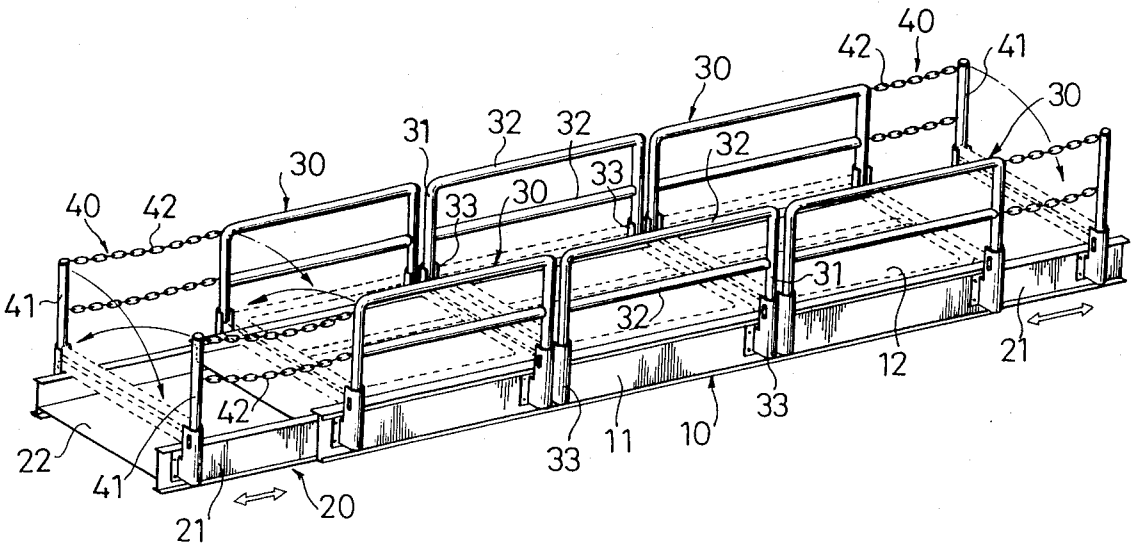
FIG. 7 is a perspective view showing an expansible corridor according to another embodiment of this invention.

FIG. 7 shows an expansible corridor of another embodiment according to this invention. The corridor according to this embodiment is formed such that the hand rail can be folded laterally of the corridor, whereas the corridor according to said embodiment is formed such that the hand rail can be folded longitudinally of the corridor.

That is, in the corridor according to this embodiment, the sub-corridor 20 enters and exits connectively both ends of the main corridor 10 so that the whole length of the corridor can be expanded and contracted. And the main corridor 10 has the scaffolding plates 12 between a pair of girder members 11 and the sub-corridor 20 has the scaffolding plates 22 between a pair of girder members 21.

The girder members 21 is inserted in the girder members 11 of the main corridor 10 to enter and exit same. Also, to the main corridor 10 and sub-corridor 20 are respectively the hand rails 30, 40. The hand rail 30 is constituted such that the cross bar 32 is connected integrally with the struts 31 having the lower ends attached foldably to the girder member 11 to form the frame body, and the lower ends of the struts 31 are inserted respectively into the sockets 33 secured fixedly to the girder member 11. And when the hand rail 30 is lifted up to raise the lower end of the strut 31 and then brought down inward in the direction of arrow, the hand rail 30 is rotated about the lower end of the strut 31 to be folded on the scaffolding 12 of the main corridor 10. Also, the hand rail 40 of the sub-corridor 20 is adapted to hold an expansible cross bar such as chain or the like on the struts 41 having the lower ends foldably attached to the girder member 21, and the lower end of the strut 41 is inserted into the socket 33 secured fixedly to the girder member 21. And the cross bar 42 engages the strut 41 on one end and is connected on the other end to the end of the hand rail 30 of the main corridor 10.

Thus, when the sub-corridor 20 enters and exits the end of the main corridor 10, the whole length of the corridor can be expanded and contracted and when the hand rail 30 is pulled up and brought down inward, it can be folded to be overlaid on the scaffolding plate 12 of the main corridor 30.

The expansible corridor thus constituted according to this invention is used in the following manner;

That is, in use, the corridor is transferred to a desired installation place by utilizing a crane or the like and spanned between horizontal support members of structure to be built, for example, pieces projecting from bottoms of a ship, beam members of a building, etc. by mounting ends of the sub-corridor 20 extended from the main corridor 10, or the corridor is transferred to a place of piece, beam member or the like by the crane or the like and then spanned by suspending both ends of the sub-corridor 20 with chains or the like hooked on the horizontal support members such as the pieces or beam members. When the corridor is transferred by the crane or the like, the sub-corridor 20 is preferably pushed into the main corridor 10 to shorten the whole length. Thus, this shortened condition is sufficiently maintained by preventing the sub-corridor 20 from sliding out of the main corridor 10.

As shown in FIG. 3, according to this invention, the sub-corridor 20 is prevented from sliding out of the main corridor 10 by the pin 14 extending through the girder member 11 of the main corridor and the girder member 21 of the sub-corridor 20. This pin 14 can be bent on the front end and folded on the rear end to extend easily through the girder members 11, 21, while being prevented from dropping out. Also, when the corridor is located in the desired position, the corridor is left suspended by crane or the like and the sub-corridor 20 is withdrawn from the main corridor 10 by a necessary length which is maintained by said pin 14 adapted to extend again through the girder member 11, 21. Thus, as shown in FIG. 2, the girder members 11, 21 of the main corridor 10 and sub-corridor 20 are provided respectively with holes 15, 25 through which said pin 14 is inserted.

Also, when this corridor is suspended and transferred to a desired installation place by the crane or the like, the hand rails 30, 40 are of course folded. And after the corridor is mounted on the desired installation place, the hand rails 30, 40 are pulled up while the lower ends of the respective struts 31, 41 are pushed downward into the respective sockets 33, 43 so that the corridor can be provided with desired hand rails. Also, in the transferring operation the hand rails 30, 40 can be subjected to so-called compacting of the corrider by pushing up the lower ends of the struts 31, 41 to withdraw them from the sockets 33, 43 and folding the corridor longitudinally or laterally so that the transferring operation can be easily carried out.

Figure 8:
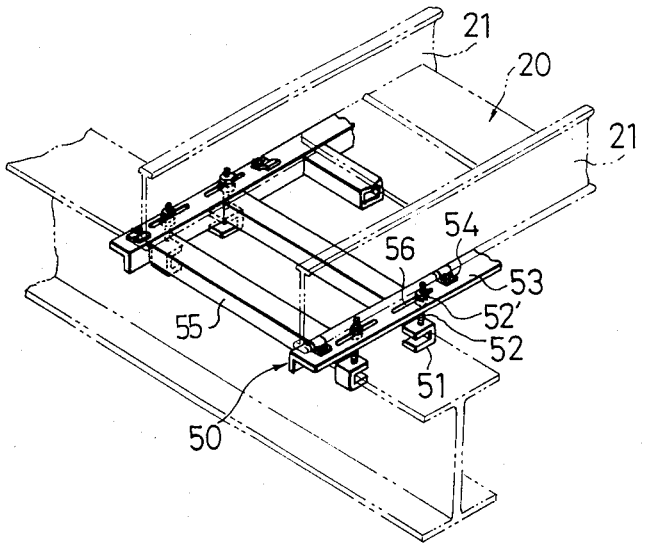
FIG. 8 is a partial perspective view showing a fixing device for fixing the corridor according to this invention to a horizontal support member.

By thus spanning the corridor between the horizontal support members such as beam members, operators can walk on the corridor, and so-called operative scaffolding for operations on building or the like can be ensured. When this corridor is spanned between the beam members or the like, it will do only by mounting it on the beam members. However, the corridor may drop very dangerously when the horizontal support members sway laterally. Thus, preferably this corridor is secured fixedly to the horizontal support members on the ends by any suitable means, and in this embodiment a fixing device 50 as shown in FIG. 8 is utilized.

That is, the ends of the expansible corridor according to this invention are held by fixing devices 50 removably attached to the horizontal support members such as beam members. This fixing device 50 is constituted from a plurality of clamps 51 removably attached to the horizontal support member, a bolt 52 vertically movably mounted on the clamp 51, a plate 53 in which this bolt 52 is inserted and which is secured fixedly by a nut 52' and a clip 54 held by the plate 53 to pinch the lower end of the girder member 21 of the sub-corridor 20. And the plate 53 is provided with a slot 56 through which the bolt 52 is inserted and which allows the bolt 52 to select any insertion position. Also, this fixing device 50 is constituted such that the respective lower ends of a pair of girder members 21 of the sub-corridor 20 are secured fixedly on the horizontal support member while the respective fixing devices 50 are integrally constituted through spacers 55 between both fixing devices 50 to meet the latral preset width of the sub-corridor 20.

Thus, when said fixing device 50 is beforehand secured fixedly to a predetermined position of the horizontal support member, the ends of the sub-corridor 20 in the corridor transferred by crane or the like can be fixed simply to the horizontal support member through the fixing device 50.

Also, the expansible corridor according to this invention in use can provide a plurality of corridors while the end of the sub-corridor 20 of one corridor can be connected to the end of the sub-corridor 20 of the other corridor by utilizing proper connector or the like to provide a further longer corridor. Also, a bracket or the like is provided in the middle of the main corridor 10 of one corridor while the end of the sub-corridor 20 of the other corridor can be connected to the bracket through any connectors to extend the corridor longitudinally and laterally.

Figure 10:
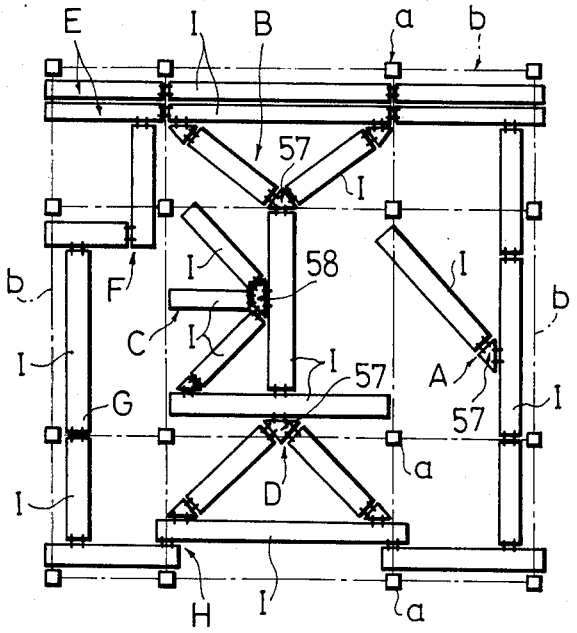
FIG. 10 is a plan view showing schematically the condition of corridor longitudinally and laterally connected to a building site.

That is, an embodiment in which a plurality of corridors are prepared to be extended longitudinally and laterally is shown as follows:

FIG. 10 shows a plan view of that embodiment of corridor I according to this invention in which corridors are longitudinally and laterally connected to each other in the form of J-shaped type A, Y-shaped type B, W-shaped type C, K-shaped type D, parallel type E, orthogonal type F, series type G, zigzag type H, etc. in any directions by utilizing steel skeleton beams b spanned between steel skeleton posts a to provide paths for operators or scaffoldings utilized for operations. Thus, they can be utilized for operators as the safe and shortest paths to work spots as well as scaffoldings facing operation spots to improve the safety and efficiency of operations.

Figure 11:
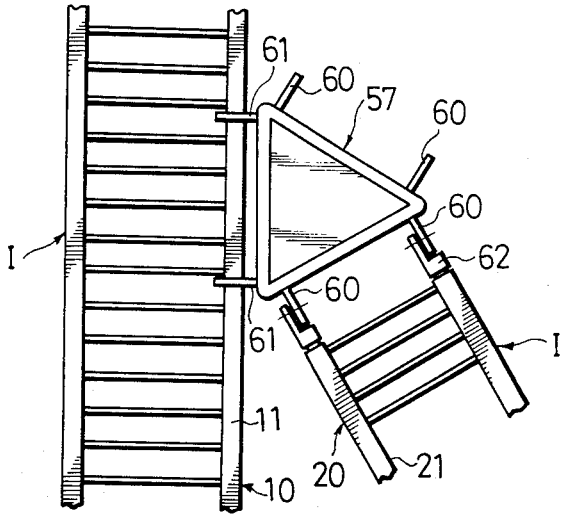
FIG. 11 is a partially cut-away schematic plan view showing the condition of a longitudinal corridor connected at an agle to another one through a connector.

Said J-shaped type A shown in FIG. 11 has corridors I connected longitudinally in series to each other by utilizing metal connectors while being slantly connected to the other corridors I by the use of a planer triangular auxiliary corridor 57. The Y-shaped type B is an example in which three corridors I are connected radially to each other through the auxiliary corridor 57, the respective corridors I being connected to other ones I. Also, the W-shaped type C is an example in which an auxiliary corridor 58 having a trapezoidal planer profile is used and three corridors I are connected to one corridor I and supported on the respective ends by utilizing steel skeleton beams b, other corridors I, etc. The K-shaped type D is an example of modification of said J-shaped type A in which three corridors I are connected to the respective sides of the triangular auxiliary corridor 57. The parallel type E is an example in which a plurelity of corridors I are arranged in parallel. The orthogonal type F is an example in which the corridors I are orthogonally connected to each other. The series type G is an example in which the corridors I are connected to each other longitudinally, and the zigzag type H is an example in which ends of corridors I are laterally arranged.

Figure 12:
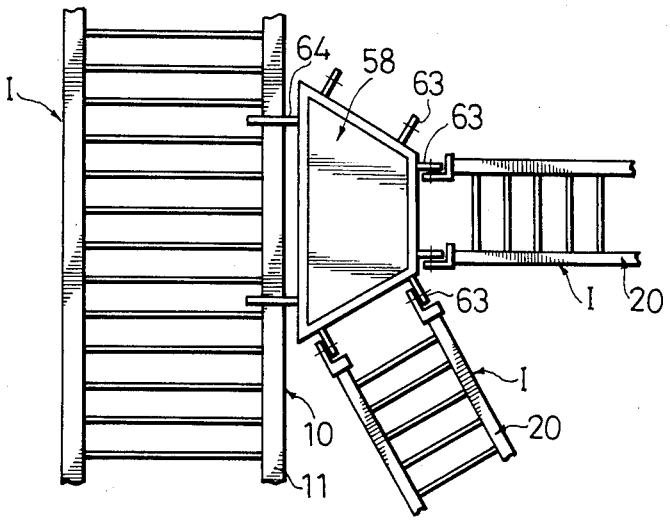
FIG. 12 is a partially cut-away schematic plan view showing the longitudinal corridor connected orthogonally or at an angle to another one.
Figure 13:
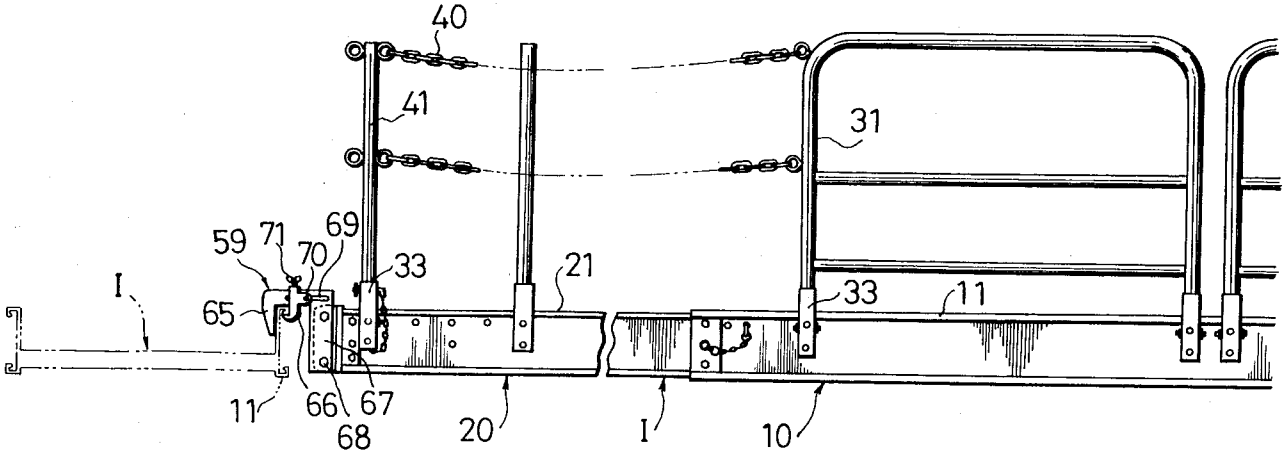
FIG. 13 is a partially cut-away side view showing the condition of two corridors connected orthogonally to each other.

In said series type G, the respective corridors I can be integrally longitudinally to each other by interconnecting metal connectors mounted on the respective corridors I. FIG. 13 shows the details of the orthogonal type F in which hook fittings 59 mounted on ends of the sub-corridor 20 are connectively hooked on the girder members 11 of the main corridor 10 or the girder members 21 of the sub-corridor 20 by dropping the hook fittings from above. The auxiliary corridors 57 used for the J-shaped type A, Y-shaped type B, K-shaped type D, etc. are, as shown in FIG. 11, constituted from a planer frame body closed on at least the upper surface and connecting fittings 60 having respectively bolt holes and provided projectingly on three sides of the frame body, or hook-like engaging fittings 61 projecting from only one side of three ones. Thus, in the case of the Y-shaped type B, the corridors I are connected to each other in three directions by the use of the auxiliary corridors 57, and in the case of the J-shaped type A or the K-shaped type D the hook-like engaging fittings 61 are hooked on the girder member of the corridor I to be connected longitudinally by fitting said fittings from above, and the other slant corridor I and the auxiliary corridor 57 are connected to each other by fastening the metal connector 62 to the connecting fitting 60 with bolts. Also, the auxiliary polygonal corridor 58, an example of which is shown in FIG. 12, is constituted from a planer trapezoidal frame body having at least the upper surface closed, connecting fittings 63 projecting from three sides and having bolt holes respectively and hook-like engaging fittings 64 provided on one side so that for example it is suitable for use as a modification of the Y-shaped type B in place of the auxiliary corridor 57 to provide the W-shaped type.

The orthogonal type E in which a longitudinal corridor is orthogonally connected to another one will be described with reference to the connected embodiment shown in FIG. 13. That is, when the longitudinal corridor I is connected to another lateral corridor I, hook fittings 59 are utilized which are provided on an end of the sub-corridor 20 in the lateral corridor I.

These hook fittings 59 have respectively a pressing member 65 fixed to an end of the sub-corridor 20 in the lateral corridor and a hook member 66 connected swingably to the pressing member 65.

The pressing member 65 is secured fixedly to an end of the sub-corridor 20 through a fixing portion 67.

The pressing member 65 is provided horizontally with a slot 69 and the pressing member 65 is held at any position through a bolt 70 inserted into this slot 69.

Also, a fastening bolt 71 is screwed into the upper portion of a hook member 66.

Hooks of the pressing members 65 are hooked on the girder member 11 is the longitudinal corridor I and then the hook members 66 are slided and hooked on a reinforcing portion 11*c* in the girder member 11. When bolts 69, 71 are then fastened, the hook member 66 is held firmly on the reinforcing portion 11*c* and at the same time the pressing member 65 is held on the girder member 11.

By thus adding or connecting each corridor one after another can be freely and easily spanned, like piers, corridors in spaces adjacent work spots in a work site to serve for necessary operations. The length of each corridor can be then adapted to the operation place by the sub-corridor entering and exiting the main corridor 10 and set by the pin 14.

Figure 14:
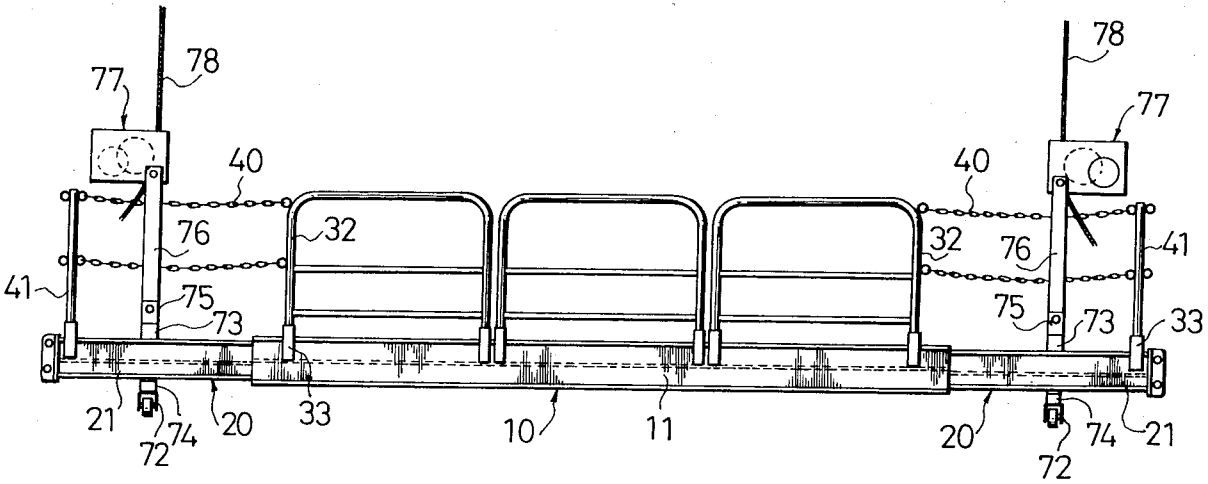
FIG. 14 is a side view showing a corridor utilized for a stage of a gondola.

Also, in FIG. 10, when the corridor I is fixedly mounted on the steel skeleton beam b, it is mounted as shown in FIG. 8. That is, the end of expansible corridor according to this invention is adapted to be held by the fixing device 50 secured fixedly removably to the horizontal support member such as beam member. Next, FIG. 14 shows an embodiment of the corridor according to this invention when it is used for a stage of gondola.

That embodiment utilizes the corridor according to that in FIG. 7 for the corridor itself.

The sub-corridors 20 are expansibly inserted into both ends of the main corridor 10.

Two support bars 73, 74 are held above and below the girder member 21 of the sub-corridor 20 in the direction of crossing the girder member 21 and coupled to each other on both ends.

To the lower support bar 74 are connected casters 72. A pair of brackets 75 are erected on both sides of the upper support bar 73 and connected to arms 76 extending upward.

Further, a winch 77 is connected to the upper ends of the arms 76 and a rope 78 is fixedly wound around the winch 77.

Thus, when the upper end of the rope 78 is held at the upper portion of a building and the corridor is suspended through the rope 78 along the wall surface of the building, this corridor can be used for a stage of a gondola on which operation on the wall surface of the building are carried out.

Further, when a motor for the winch 77 is driven, the rope 78 is extended or taken up to move vertically the corridor of gondola.

Also, the lateral width of the stage can be adjusted by expanding and contracting the sub-corridor 20 according to the operation area.

This, by the expansible corridor according to this invention can provide a desired corridor without needing any preparation for the large number of members having different lengths or the like and any assembling operations utilizing the large number of members in an installation site when the corridor is provided in the desired installation site. As a result, the ordering and storage of a large number of members for installing the corridor and further preparatory operations such as preparatory plan of assembly operation can be omitted, while labor and time for assembling the corridor can be saved to reduce the period and expense for construction of structures. Also when the corridor is suspended and transferred by crane or the like or stored and transported in an idle time, the whole length of the corridor can be shortened while the hand rails can be also folded so that so-called compact corridor can be provided, and the suspension by the crane, storage, transportation and transfer in the idle time can be effectively simply carried out. Further, a desired corridor can be provided irrespective of the distance between the horizontal support members while a plurality of corridors can be connected to each other by the use of proper connectors to provide further longer corridors and mesh-like ones so that footpaths for operators and so-called operation scaffoldings can be advantageously simply ensured. That is, since the corridors provided with connectors according to this invention can be arranged to have any shapes and heights according to work sites by adding or connecting corridors having any lengths, spaces in the work site can be effectively utilized. Further, since the corridors can be erected like piers, the shortest distance can be provided to the path for operators to shorten the operation time while improving the safety and efficiency of operation when the corridor provides the scaffolding for operation. Also, when the respective corridors have metal connectors or hook fittings, the method of arrangement can be easily changed in any way by altering the connecting condition to be simply changed over to operations in the other operation sites.

What is claimed is:

1. A corridor assembly for spanning a plurality of horizontal supports, comprising:

a main corridor having a pair of spaced-apart hollow girder members, each girder member having an outer shell and an inner longitudinal opening, and a horizontal scaffolding plate connected between said hollow girder members;

a sub-corridor having a pair of spaced-apart girder members telescopically received for horizontal sliding in respective ones of said hollow girder members, and a horizontal scaffolding plate connected between said pair of girder members of said sub-corridor, said scaffolding plates of said main corridor and said sub-corridor being at different horizontal locations and said scaffolding plate of said sub-corridor extending through said longitudinal openings of said hollow members so that said sub-corridor can telescopically slide with respect to said main corridor;

a first foldable handrail connected to each of said hollow girder members of said main corridor foldable from an upright position on said hollow girder members to a folded position lying in a plane substantially parallel to a plane of said horizontal scaffold plate of said main corridor; and a second foldable handrail connected to each of said girder members of said sub-corridor, each second foldable handrail foldable from an upright position to a folded position lying substantially parallel to said scaffolding plate of said sub-corridor, each of said second foldable handrails being connected to one of said first foldable handrails so that said first and second handrails remain connected while said sub-corridor telescopically slides with respect to said main corridor.

2. A corridor assembly according to claim 1, wherein each of said hollow girder members includes an inside shell connected to said outside shell and extending vertically on one side of said longitudinal opening, each girder member of said sub-corridor being slidably mounted between said inner and outer shells of one of said hollow girder members of said main corridor, said horizontal scaffolding plate of said main corridor being connected between said inside shell of said hollow girder member whereby said girder members of said sub-corridor are laterally and vertically supported for sliding movements in said hollow girder members.

3. A corridor assembly according to claim 2, wherein each of said inside shells extend vertically over said longitudinal opening, a horizontal support portion connected to a lower end of each inside shell, said support portion extending toward each other, said horizontal scaffolding plate of said main corridor being connected to said horizontal support portion, on said horizontal support portions and between said horizontal support portion, each girder member of said sub-corridor having a support portion extending inwardly of said sub-corridor, said scaffolding plate of said sub-corridor being connected to, on, and between said support portion of said sub-corridor, said horizontal scaffolding plate of said sub-corridor lying under said scaffolding plate of said main corridor.

4. A corridor assembly according to claim 3, including a riser connected to said outer shell of each hollow support portion and rising upwardly toward said longitudinal opening of each hollow girder members, said scaffolding plate of said sub-corridor extending above said risers, and a foot securing member connected between said risers.

5. A girder assembly according to claim 4, including a reinforcing portion connected to the outside of each of said girder members of said main and sub-corridors, and near top ends of said girder members.

6. A corridor assembly according to claim 2, including a riser connected to said outer shell of each hollow girder member and rising under said longitudinal opening, said scaffolding plate of said main corridor being connected between said risers and being positioned below said scaffolding plates of said sub-corridor.

7. A corridor assembly according to claim 1, including a polygonal horizontal auxiliary corridor plate having a plurality of sides extending at angles to each other, and connector means at each side of said auxiliary corridor plate for connection to at least one of said girder members, girder members of other corridor assemblies being connectable to connector means at other sides of said polygonal auxiliary corridor plate for connecting a plurality of corridor assemblies together.

8. A corridor assembly according to claim 7, wherein said auxiliary corridor plate is triangular and has three sides with connector means at each three sides.

9. A corridor assembly according to claim 7, wherein said corridor plate is trapezoidal and has four sides each provided with said connector means.

10. A corridor assembly according to claim 7, wherein each of said inside shells extend vertically over said longitudinal opening, a horizontal support portion connected to a lower end of each inside shell, said support portion extending toward each other, said horizontal scaffolding plate of said main corridor being connected to said horizontal support portion, on said horizontal support portions and between said horizontal support portion, each girder member of said sub-corridor having a support portion extending inwardly of said sub-corridor, said scaffolding plate of said sub-corridor being connected to, on, and between said support portion of said sub-corridor, said horizontal scaffolding plate of said sub-corridor lying under said scaffolding plate on said main corridor.

11. A corridor assembly according to claim 10, including a riser connected to said outer shell of each hollow support portion and rising upwardly toward said longitudinal opening of each hollow girder members, said scaffolding plate of said sub-corridor extending above said risers, and a foot securing member connected between said risers.

12. A girder assembly according to claim 11, including a reinforcing portion connected to the outside of each of said girder members of said main and sub-corridors, and near top ends of said girder members.

13. A corridor assembly according to claim 12, wherein said connector means each comprise a pair of hook-shaped pressing members fixed to said auxiliary corridor plate for engaging around one of said girder members, a hook member pivotally mounted to said pressing member for engaging a reinforcing portion of said one of said girder members and fixing means for fixing said hook member, when engaged with said reinforcing portion, to said pressing member.

14. A corridor assembly according to claim 12, wherein each pressing member includes a slot, each hook member having a bolt extending therethrough and extending into said slot, said fixing means comprising a nut threaded to said hook member and engageable against said pressing member.

15. A corridor assembly according to claim 14, wherein said hand rails of said main corridor comprise a plurality of sockets connected to said outer shell of said hollow girder member, each socket being laterally open and having slots therein, a strut slible with said pin sliding in said slot to a position where each strut can be pivoted through said lateral opening into a horizontal position and cross bars connected between said struts.

16. A corridor assembly according to claim 15, including one socket connected to an outside of each girder member of said sub-corridor at an end of each girder member spaced away from said hollow girder members of said main corridor, each socket of said sub-corridor being laterally open and having slots therein, a strut having a pin connected thereto and extending in said slots of said socket for said sub-corridor, each strut of said sub-corridor being slidable upwardly and pivotable through the lateral opening of said socket of said sub-corridor to move from an upright position to a horizontal position, and a further cross bar connected to each strut of said sub-corridor and telescopically engaged with said cross-bar of said main corridor.

17. A corridor assembly according to claim 14, wherein said hand rails of said main corridor comprise a plurality of sockets connected to said outer shell of said hollow girder member, each socket being laterally open and having slots therein, a strut slidably mounted in each socket, a pin connected to each strut and extending through slots of each socket, each strut being raisable with said pin sliding in said slot to a position where each strut can be pivoted through said lateral opening into a horizontal position and cross bars connected between said struts.

18. A corridor assembly according to claim 17, including one socket connected to an outside of each girder member of said sub-corridor at an end of each girder member spaced away from said hollow girder members of said main corridor, each socket of said sub-corridor being laterally open and having slots therein, a strut having a pin connected thereto and extending in said slots of said socket for said sub-corridor, each strut of said sub-corridor being slidable upwardly and pivotably through the lateral opening of said socket of said sub-corridor to move from an upright position to a horizontal position, and a further cross bar connected to each strut of said sub-corridor and telescopically engaged with said crossbar of said main corridor.

* * * * *